US006884089B2

(12) United States Patent
Obikane et al.

(10) Patent No.: US 6,884,089 B2
(45) Date of Patent: Apr. 26, 2005

(54) ELECTRICAL CONNECTOR WITH FIXITY MEMBERS HAVING SIMILAR SHAPES AS CONTACTS FROM WHICH CONTACT PORTIONS ARE OMITTED

(75) Inventors: Hiroaki Obikane, Tachikawa (JP); Toshio Masumoto, Musashimurayama (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/673,900

(22) Filed: Sep. 29, 2003

(65) Prior Publication Data

US 2004/0102065 A1 May 27, 2004

(30) Foreign Application Priority Data

Sep. 30, 2002 (JP) ..... 2002-286655

(51) Int. Cl.[7] ..... H01R 12/00
(52) U.S. Cl. ..... 439/74; 439/571
(58) Field of Search ..... 439/74, 571, 527, 439/43, 44, 108, 55, 65, 572

(56) References Cited

U.S. PATENT DOCUMENTS 5,915,976 A * 6/1999 McHugh ..... 439/74
5,928,031 A 7/1999 Chishima ..... 439/571
6,135,785 A * 10/2000 Niitsu ..... 439/74
6,276,942 B1 * 8/2001 Hsiao ..... 439/74
6,338,630 B1 * 1/2002 Dong ..... 439/74
6,464,515 B1 * 10/2002 Wu ..... 439/108

FOREIGN PATENT DOCUMENTS

| | | |
|---|---|---|
| DE | 0 440 016 A1 | 8/1991 |
| DE | 0 795 939 A2 | 9/1997 |
| DE | 1 148 597 A2 | 10/2001 |
| GB | 0 538 029 A2 | 4/1993 |
| GB | 0 685 907 A2 | 12/1995 |
| JP | U-H05-23429 | 3/1993 |
| JP | 09-364881 | 12/1997 |
| JP | 2001-126789 | 5/2001 |
| JP | 2002-033145 | 1/2002 |

* cited by examiner

*Primary Examiner*—Michael C. Zarroli
(74) *Attorney, Agent, or Firm*—Collard & Roe, P.C.

(57) ABSTRACT

A surface mountable connector (100) comprises an insulator (10), a plurality of contacts (30) and a plurality of fixity members (40). The contacts (30) are held by the insulator (10). Similarly, the fixity members (40) are held by the insulator (10). The fixity member (40) has a specific shape similar to the contact (30) except for a contact portion of the contact (30) which is a part of the contact (30) brought into contact with a contact of a mating connector when the connector (100) is mated with the mating connector. The fixity member (40) can be easily manufactured by cutting off the contact portion from the contact (30).

12 Claims, 11 Drawing Sheets

ELECTRICAL CONNECTOR WITH FIXITY MEMBERS HAVING SIMILAR SHAPES AS CONTACTS FROM WHICH CONTACT PORTIONS ARE OMITTED

This application claims priority to prior Japanese patent application JP 286655/2002, the disclosure of which is incorporated herein by reference.

BACKGROUND OF THE INVENTION

This invention relates to a connector which is mountable on a surface of a substrate such as a printed circuit board and is connectable to a mating connector in a direction perpendicular to the surface of the substrate.

When the mating connector is disconnected from the connector of the above-mentioned type, the connector is given a large reaction force such that the connector is intended to be removed from the printed circuit board. To prevent the connector from being undesirably removed from the printed circuit board, the connector is provided with fixity members, which serve to fix or secure the connector on the printed circuit board. Such a connector is disclosed in JP-U H05-23429.

The connector of JP-U H05-23429 comprises an insulator, which is formed with slots. The slots are positioned at the opposite ends of the insulator in the longitudinal direction of the insulator, respectively. Into the slots, fixity members are inserted. The fixity members are soldered to a printed circuit board so that the connector is also fixed thereto.

SUMMARY OF THE INVENTION

It is an object of the present invention to provide a connector which has improved fabrication ease and allows fabrication costs to decrease.

This invention is applicable to a connector which is mountable in/on a surface of a substrate and is connectable to a mating connector in a first direction perpendicular to the surface of the substrate. The connector comprises an insulator, a plurality of contacts and a plurality of fixity members. The insulator is formed with a plurality of first holding portions for holding the respective contacts and a plurality of second holding portions for holding the respective fixity members. The first and the second holding portions (21, 22) are arranged in a second direction perpendicular to the first direction. Each of the contacts has a first held portion held by the corresponding one of the first holding portions, a first fixing portion for fixing the contact on the surface of the substrate, and a contact portion for being brought into contact with contacts of the mating connector. The fixity members serve to fix the insulator to the substrate in cooperation with the first fixing portions of the contacts. The connector according to this invention is characterized in that:

- each of the fixity members is made of the same material as the contacts and is comprised of a second held portion and a second fixing portion;
- the second held portion has the same shape as the first held portion and is held by the corresponding one of the second holding portions of the insulator; and
- the second fixing portion has the same shape as the first fixing portion and is for fixing the fixity member on the surface of the substrate.

Figure 1:
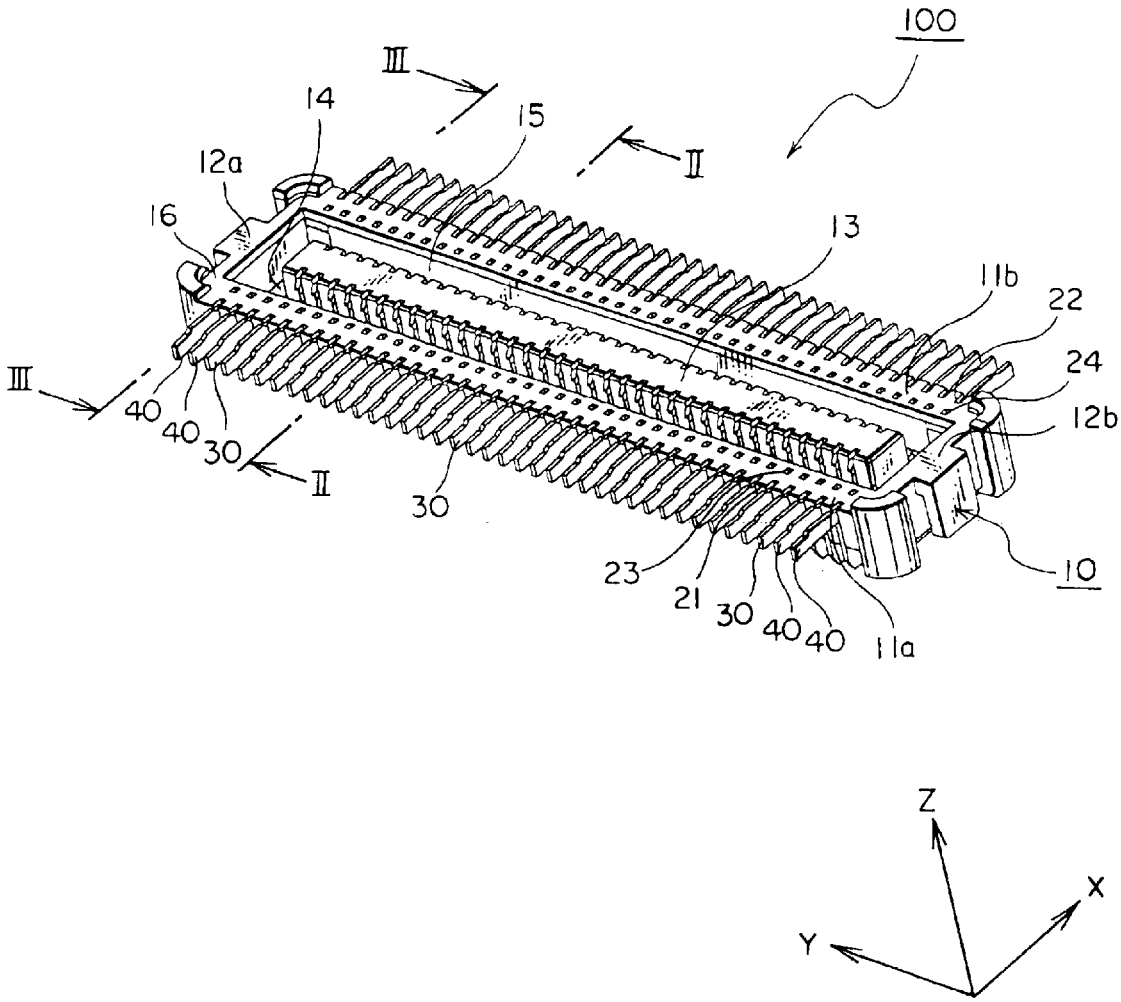
FIG. 1 is a perspective view showing a connector according to a first embodiment of the present invention.
Figure 2:
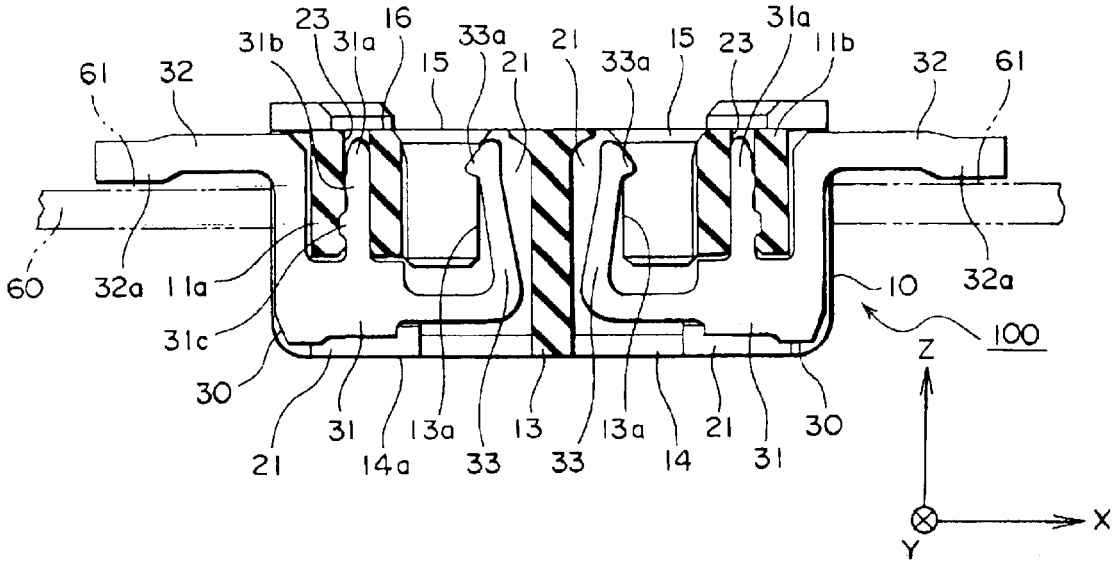
FIG. 2 is a cross-sectional view showing the connector of FIG. 1, taken along lines II—II.
Figure 3:
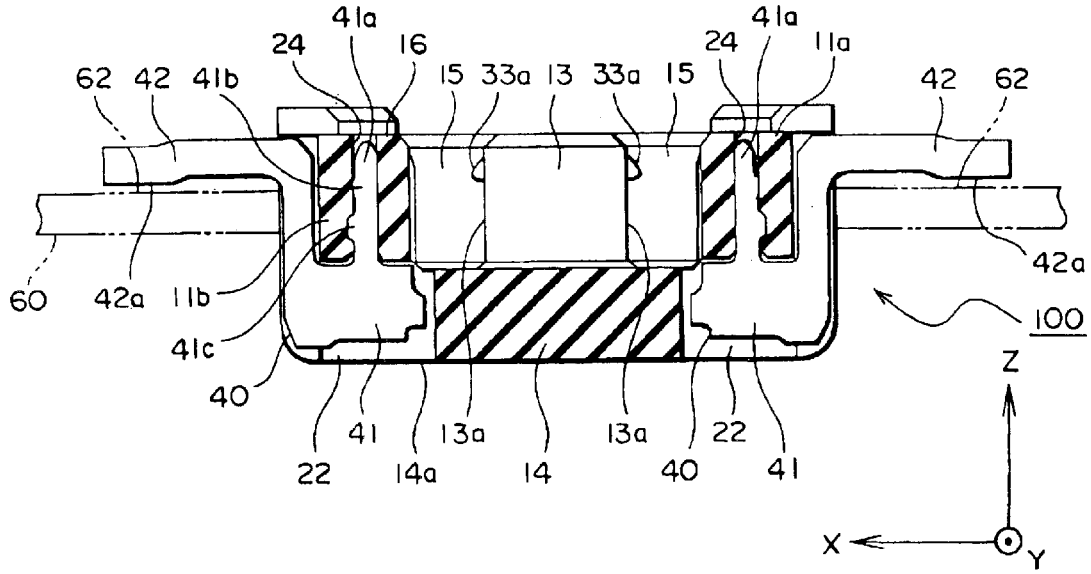
FIG. 3 is a cross-sectional view showing the connector of FIG. 1, taken along lines III—III.
Figure 10:
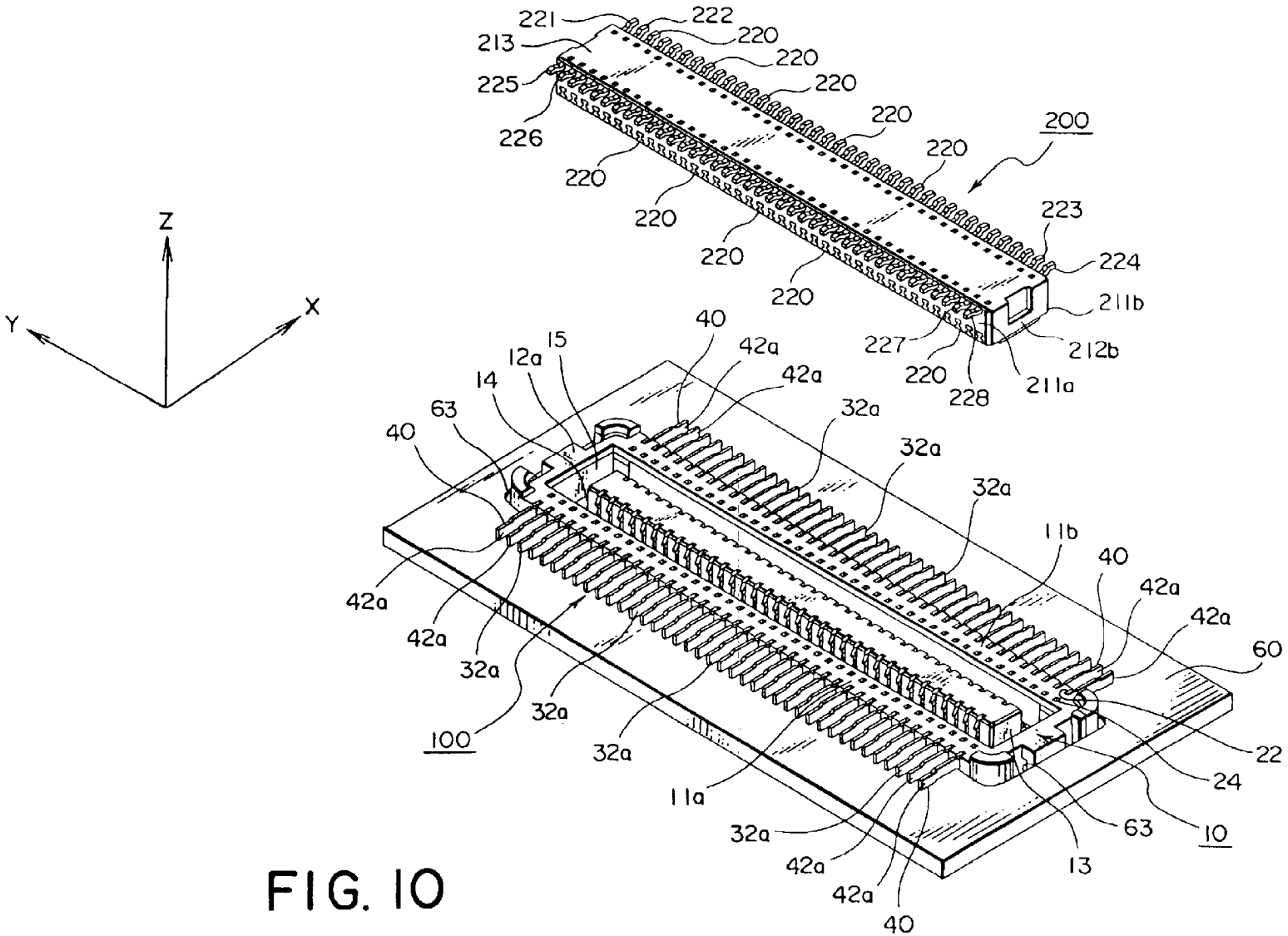
FIG. 10 is a perspective view showing the connector of FIG. 1 and the mating connector of FIG. 7.
Figure 11:
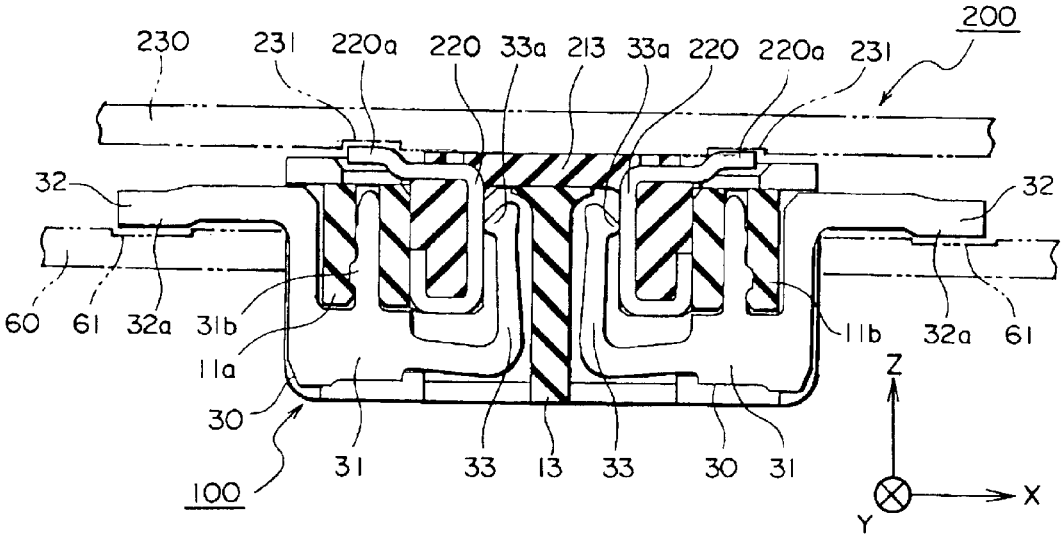
FIG. 11 is a cross-sectional view showing a combination of the connector of FIG. 1 and the mating connector of FIG. 7, corresponding to FIGS. 2 and 8.
Figure 12:
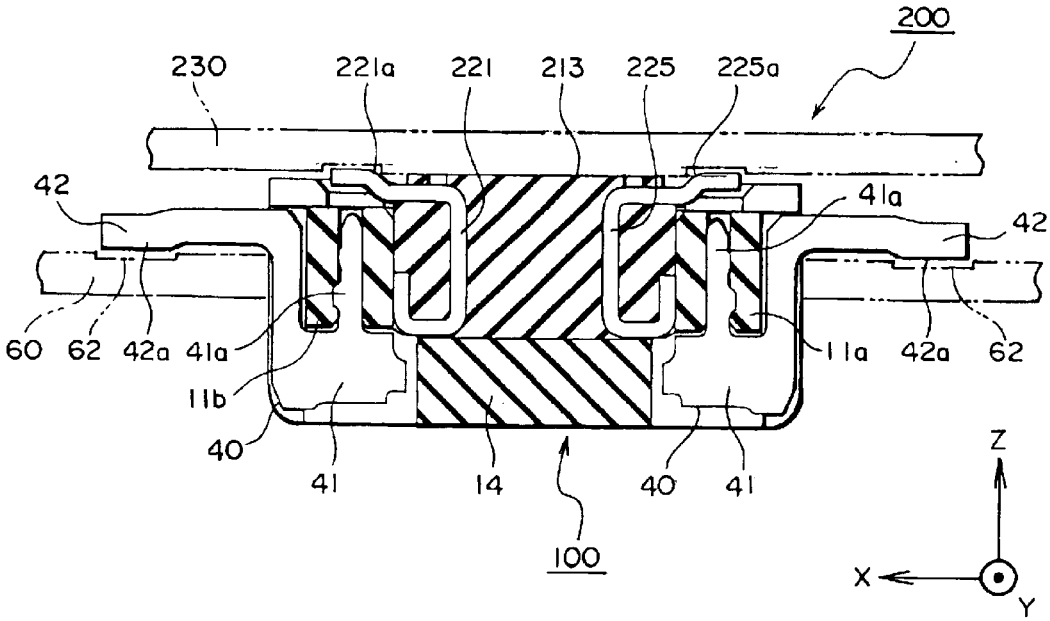
FIG. 12 is a cross-sectional view showing a combination of the connector of FIG. 1 and the mating connector of FIG. 7, corresponding to FIGS. 3 and 9.

DESCRIPTION OF PREFERRED EMBODIMENTS:

With reference to FIGS. 1 to 5, a connector 100 according to a first embodiment of the present invention comprises an insulator 10, a plurality of contacts 30, and a plurality of fixity members 40. As shown in FIGS. 2, 3 and 10, the connector 100 is fixed to a substrate 60 by the fixity members 40 and the contacts 30. As shown in FIGS. 10 to 12, the connector 100 is fitted with and connected with a mating connector 200 in a Z-direction.

As shown in FIGS. 1 to 3, the insulator 10 is comprised of a pair of first wall portions 11*a*, 11*b*, a pair of second wall portions 12*a*, 12*b*, a center island portion 13 and a bottom portion 14. Each of the first wall portions 11*a*, 11*b* stands up from the bottom portion 14 upwardly in the Z-direction and extends in a Y-direction perpendicular to the Z-direction.

The first wall portions 11*a*, 11*b* are spaced from each other in an X-direction perpendicular to the Y- and the Z-directions.

Each of the second wall portions 12*a,* 12*b* stands up from the bottom portion 14 upwardly in the Z-direction and extends in the X-direction. The second wall portion 12*a* connects one end of the first wall portion 11*a* and another end of the first wall portion 11*b,* while the second wall portion 12*b* connects the other end of the first wall portion 11*a* and the other end of the first wall portion 11*b.* Thus, the first and the second wall portions 11*a,* 11*b,* 12*a,* 12*b* constitute an elongated, rectangular enclosure.

The center island portion 13 stands up from the bottom portion 14 upwardly in the Z-direction. The center island portion 13 is spaced from the first wall portions 11*a,* 11*b* in the X-direction and is also spaced from the second wall portions 12*a,* 12*b* in the Y-direction so that an elongated O-like shaped groove 15 is defined between the center island 13 and the first and the second wall portions 11*a,* 11*b,* 12*a,* 12*b.*

Each of the first wall portions 11*a,* 11*b* is formed with a plurality of first holding grooves 21 for holding the respective contacts 30 and a plurality of second holding grooves 22 for holding the respective fixity members 40. The first and the second holding grooves 21, 22 are spaced at regular intervals in the Y-direction and are arranged parallel to each other. Each of the second holding grooves 22 is positioned next to the outermost one of the first holding grooves 21 in the Y-direction. The first holding grooves 21 are positioned between the second holding grooves 22 in the Y-direction.

As shown in FIG. 2, each of the first holding grooves 21 is continuously formed in the first wall portion 11*a,* 11*b,* the bottom portion 14, and the center island portion 13 so that it has a U-like shaped cross-section. The first holding groove 21 communicates with the elongated O-like shaped groove 15 and a lower surface 14*a* of the bottom portion 14. The first holding groove 21 also communicates with an outer side of the first wall portion 11*a,* 11*b.* The first holding groove 21 is provided with a fitting hole 23, which extends from the bottom portion 14 to an upper surface 16 of the insulator 10 in the Z-direction.

As shown in FIG. 3, each of the second holding grooves 22 is continuously formed in the first wall portion 11*a,* 11*b* and the bottom portion 14 but is not formed in the center island portion 13 so that it has an L-like shaped cross-section. In this embodiment, the second holding groove 22 communicates with the elongated O-like shaped groove 15. However, the second holding groove 22 may be isolated from the elongated O-like shaped groove 15. The second holding groove 22 communicates with the lower surface 14*a* of the bottom portion 14 and the outer side of the first wall portion 11*a,* 11*b.* The second holding groove 21 is provided with a fitting hole 24, which extends from the bottom portion 14 to the upper surface 16 of the insulator 10 in the Z-direction.

Figure 4:
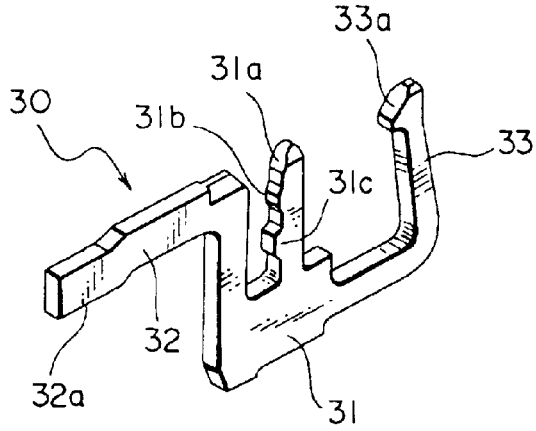
FIG. 4 is a perspective view showing a contact which is included in the connector of FIG. 1.

As shown in FIG. 4, each of the contacts 30 is comprised of a held portion 31, a fixing portion 32 and a contact portion 33. The held portion 31 has an L-like shape and is provided with a fitting post 31*a.* The fitting post 31*a* extends from one edge of the held portion 31 vertically and is formed with two engagement portions 31*b,* 31*c.* The fixing portion 32 extends from an end of the other edge of the held portion 31 and away from the fitting post 31*a.* The free end of the fixing portion 32 serves as a soldered portion 32*a.* When the connector 100 is mounted on the substrate 60, the soldered portion 32*a* is soldered to the substrate 60 so that the contact 30 is fixed to the substrate 60, as described afterwards. The contact portion 33 is formed with a projection 33*a,* which is positioned at a free end of the contact portion 33.

As shown in FIG. 2, the contact 30 is inserted into the insulator 10 from the bottom portion 14 so that it is held by the insulator 10. In detail, the fitting post 31*a* is inserted into the fitting hole 23, while the engagement portions 31*b,* 31*c* are engaged in the inner surface of the fitting hole 23 so that the press-fitting is established between the fitting post 31*a* and the fitting hole 23. The held portion 31 and the contact portion 33 are held by the first holding groove 21, while the projection 33*a* projects from a side 13*a* of the center island portion 13 in the elongated O-like shaped groove 15. In other words, the projection 33*a* projects towards the corresponding fixing portion 32. The fixing portion 32 projects from the outer side of the first wall portion 11*a,* 11*b* outwardly of the insulator 10.

Figure 5:
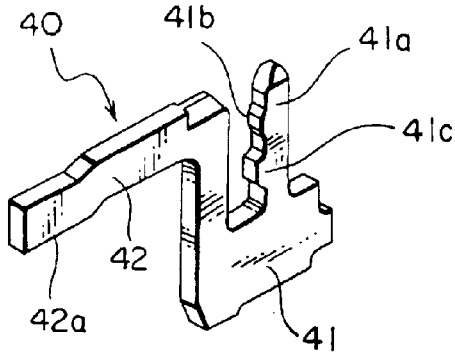
FIG. 5 is a perspective view showing a fixity member which is included in the connector of FIG. 1.

As shown in FIG. 5, each of the fixity members 40 is comprised of a held portion 41 and a fixing portion 42. The held portion 41 has the same shape as the held portion 31. The held portion 41 is also provided with a fitting post 41*a,* which has the same shape as the fitting post 31*a* and is also formed with two engagement portions 41*b,* 41*c.* The fixing portion 42 has the same shape as the fixing portion 32. The free end of the fixing portion 42 also serves as a soldered portion 42*a* similar to the soldered portion 32*a.* However, the fixity member 40 has no contact portion like the contact portion 33.

Figure 6:
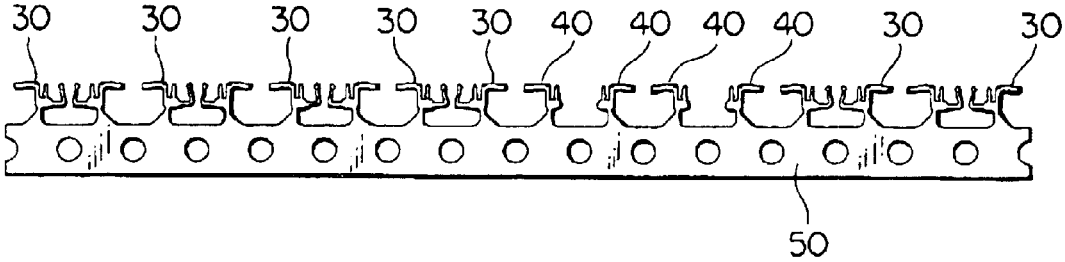
FIG. 6 is a top plan view showing a carrier, with which the contacts of FIG. 4 and the fixity members of FIG. 5 are formed.

The fixity member 40 can be easily manufactured by cutting off the contact portion 33 from the contact 30. In practice, the contacts 30 are manufactured by stamping off a metal plate. The fixing members 40 are formed by selecting some contacts 30, followed by cutting away their contact portions while a carrier 50 is still connected thereto, as shown in FIG. 6. As also understood from FIG. 6, the fixing members 40 are made of the same material as the contacts 30, i.e. metal in this embodiment.

As shown in FIG. 3, the fixity member 40 is inserted into the insulator 10 from the bottom portion 14 so that it is held by the insulator 10. In detail, the fitting post 41*a* is inserted into the fitting hole 24, while the engagement portions 41*b,* 41*c* are engaged in the inner surface of the fitting hole 24 so that the press-fitting is established between the fitting post 41*a* and the fitting hole 24. The held portion 41 is held by the second holding groove 22. The fixing portion 42 projects from the outer side of the first wall portion 11*a,* 11*b* outwardly of the insulator 10.

Because the first and the second holding grooves 21, 22 are spaced at regular intervals and the contacts 30 and the fixity members 40 have the same shape as each other except for the contact portions 33 of the contacts 30, it is easy to fit the contacts 30 and the fixity members 40 into the first and the second holding grooves 21, 22, respectively, by means of an automatic fitting machine.

As shown in FIGS. 2, 3 and 10, the fixing portions 32, 42 are placed on the surface of the substrate 60 while the insulator 10 is placed within a hole 63 of the substrate 60 so that the connector 100 is mounted on the substrate 60. The soldered portions 32*a,* 42*a* are arranged on conductive portions 61, 61, respectively, and are soldered thereto so that the contacts 30 and the fixity members 40 are fixed to the substrate 60 and, accordingly, the connector 100 is also fixed to the substrate 60.

In this embodiment, the contacts 30 and the fixity members 40 are grouped into two groups. Specifically, thirty-five contacts 30 and four fixity members 40 constitute one set, wherein the contacts 30 are positioned between two fixity members 40 and the other two fixity members 40. The other set of the contacts 30 and the fixity members 40 has the same configuration as the aforementioned set but the one and the other sets of the contacts and the fixity members 40 are arranged symmetrically with each other in the X-direction, as shown in FIGS. 1 and 10. With the above-mentioned arrangements, two fixity members 40 are positioned near to each corner of the connector 100. In other words, every fixity member 40 is positioned nearer to the corresponding corner of the connector 100 than the contacts 30. Therefore, the fixation of the connector 100 by means of the fixity members 40 is resistant to a rotation force which might be applied to the connector 100. The number of the fixity members 40 arranged near to each corner of the connector is not limited to two but may be one or three or more.

As shown in FIGS. 7 to 10, the mating connector 200 is comprised of an insulator 210, a plurality of contacts 220 and a plurality of dummy contacts 221–228. The insulator 210 is comprised of a pair of first wall portions 211*a*, 211*b*, a pair of second wall portions 212*a*, 212*b* and a bottom portion 213. Each of the first wall portions 211*a*, 211*b* stands up from the bottom portion 213 and extends in the Y-direction. The first wall portions 211*a*, 211*b* are spaced from each other in the X-direction. Each of the second wall portions 212*a*, 212*b* stands up from the bottom portion 213 and extends in the X-direction. The second wall portions 212*a*, 212*b* are spaced from each other in the Y-direction. The second wall portion 212*a* connects one end of the first wall portion 211*a* and another end of the first wall portion 211*b*, while the second wall portion 212*b* connects the other end of the first wall portion 211*a* and the other end of the first wall portion 211*b* so that an elongated groove 214 is defined by the first and the second wall portions 211*a*, 211*b*, 212*a*, 212*b* and the bottom portion 213.

Figure 8:
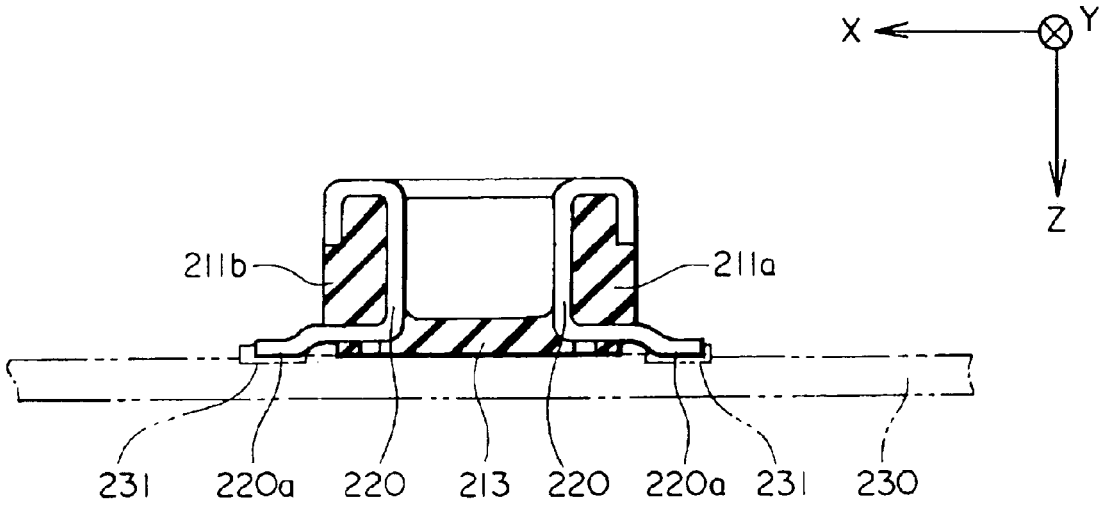
FIG. 8 is a cross-sectional view showing the mating connector of FIG. 7, taken along lines VIII—VIII.
Figure 9:
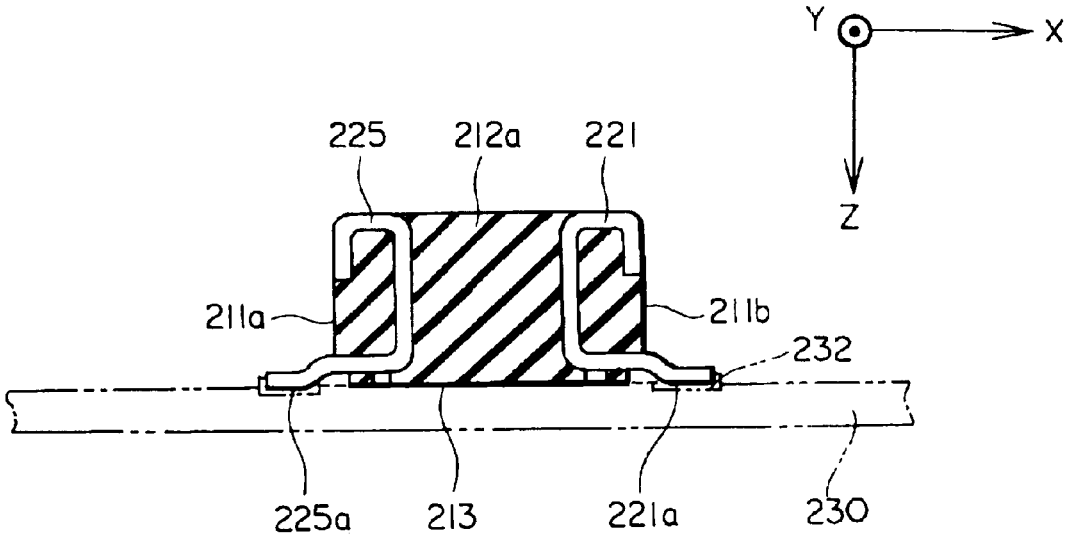
FIG. 9 is a cross-sectional view showing the mating connector of FIG. 7, taken along lines IX—IX.

As especially shown in FIGS. 8 and 9, the contacts 220 and the dummy contacts 221–228 have the same shape as each other. The dummy contacts 221–228 are used only for fixing the mating connector 200 to another substrate 230 and correspond to the respective fixity members 40 of the connector 100. Therefore, the dummy contacts 221–228 are not required to be electrically connected to a circuit on the substrate 230.

Figure 7:
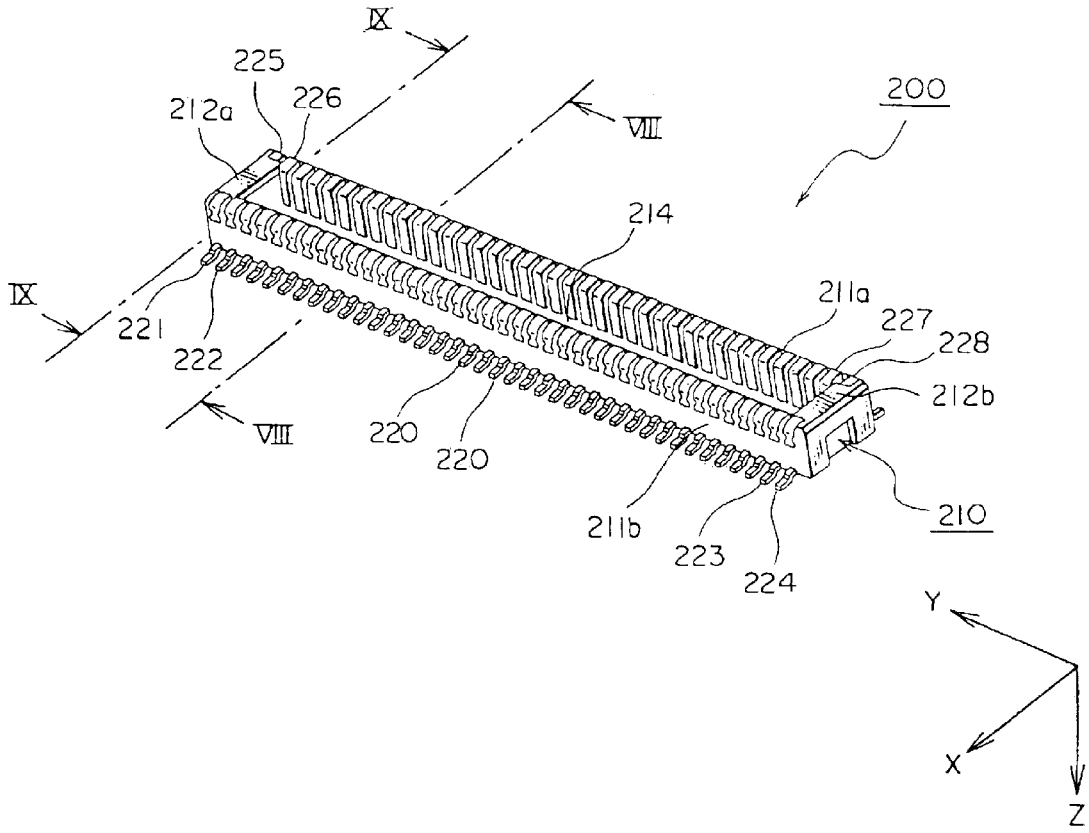
FIG. 7 is a perspective view showing a mating connector for the connector of FIG. 1.

As shown in FIG. 7, in this embodiment, the number of the dummy contacts 221–228 is eight and is same as the number of the fixity members 40 of the connector 100. The number of the contacts 220 is same as the number of the contacts 30 of the connector 100. Specifically, the contacts 220 and the dummy contacts 221–228 are grouped into two groups, each of which has thirty-five contacts 220 and four dummy contacts 221–224 or 225–228, wherein the thirty-five contacts 220 are arranged between two dummy contacts 221, 222 or 225, 226 and the other two dummy contacts 223, 224 or 227, 228. Thus, the configuration of the contacts 220 and the dummy contacts 221–228 correspond to the configuration of the contacts 30 and the fixity members 40 of the connector 100.

As seen from FIGS. 8 and 9, the mating connector 200 is mounted and fixed on the substrate 230 by soldering soldered portions 220*a*, 221*a*, 225*a* to conductive portions 231, 232 provided on the substrate 230.

As seen from FIGS. 10 to 12, when the connector 100 is mated with the mating connector 200, the center island portion 13 of the connector 100 is inserted into the elongated groove 214 of the mating connector 200 while the first and the second wall portions 211*a*, 211*b*, 212*a*, 212*b* of the mating connector 200 are inserted into the elongated O-like shaped groove 15 of the connector. Under the mated state, the projections 33*a* of the contacts 30 of the connector 100 are brought into contact with the contacts 220 of the mating connector 200. However, the dummy contacts 221–228 of the mating connector 200 are not in contact with the fixity members 40 of the connector 100 so that there is no electrical connection between the dummy contacts 221–228 and the fixity members 40.

In FIGS. 13 to 17, a connector 300 according to a second embodiment of the present invention is illustrated. The connector 300 comprises an insulator 310, a plurality of contacts 330, and a plurality of fixity members 340.

Figure 13:
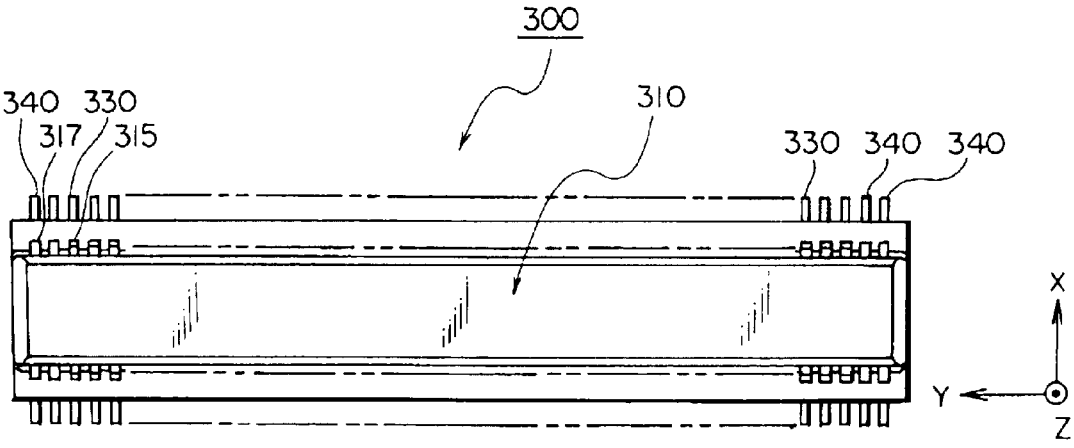
FIG. 13 is a top plan view showing a connector according to a second embodiment of the present invention.
Figure 14:
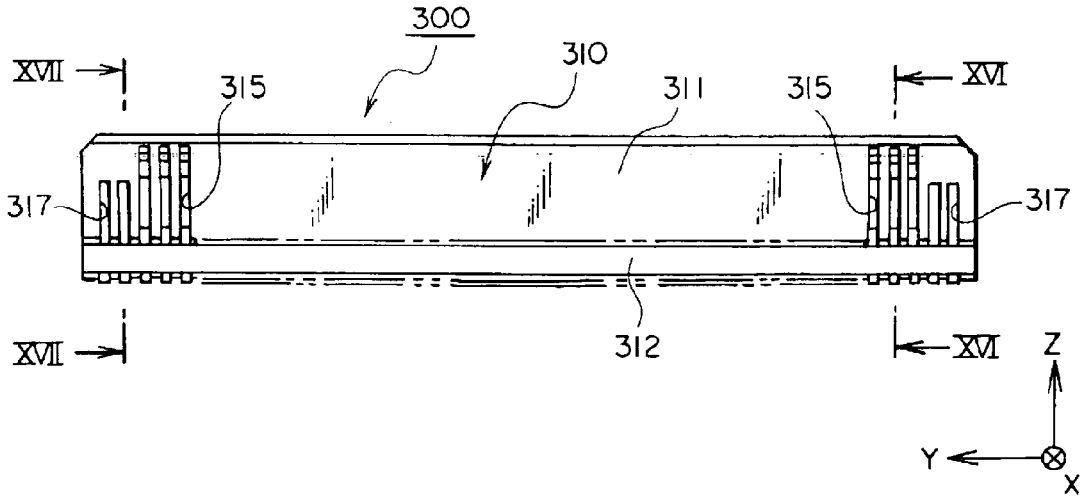
FIG. 14 is a side view showing the connector of FIG. 13.
Figure 15:
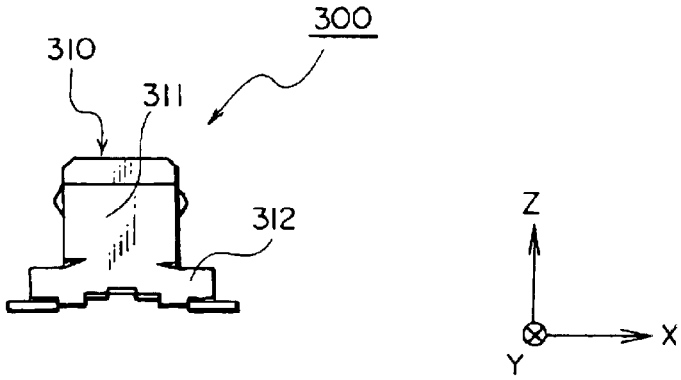
FIG. 15 is another side view showing the connector of FIG. 13.

As shown in FIGS. 13 to 15, the insulator 310 is comprised of an insertion head portion 311 and a bottom portion 312. The bottom portion 312 has a plate-like shape which has a depressed lower surface. The insertion head portion 311 stands on the bottom portion 312 and extends in the Z-direction. The insertion head portion 311 has the same size as the bottom portion 312 in the Y-direction but is smaller than the bottom portion 312 in the X-direction. The bottom portion 312 is mountable on a substrate, which is not shown in this embodiment. The insertion head portion 311 is to be inserted into a fitting groove which is provided for a mating connector not shown, wherein the fitting groove has an elongated, rectangular groove.

As shown in FIGS. 13, 14, 16, 17, the insulator 310 is formed with a plurality of first holding portions 315 and a plurality of second holding portions 317. In this embodiment, the first holding portion 315 is a slit which has a particular shape shown in FIG. 16, while the second holding portion 317 is another slit which has another shape shown in FIG. 17.

Figure 16:
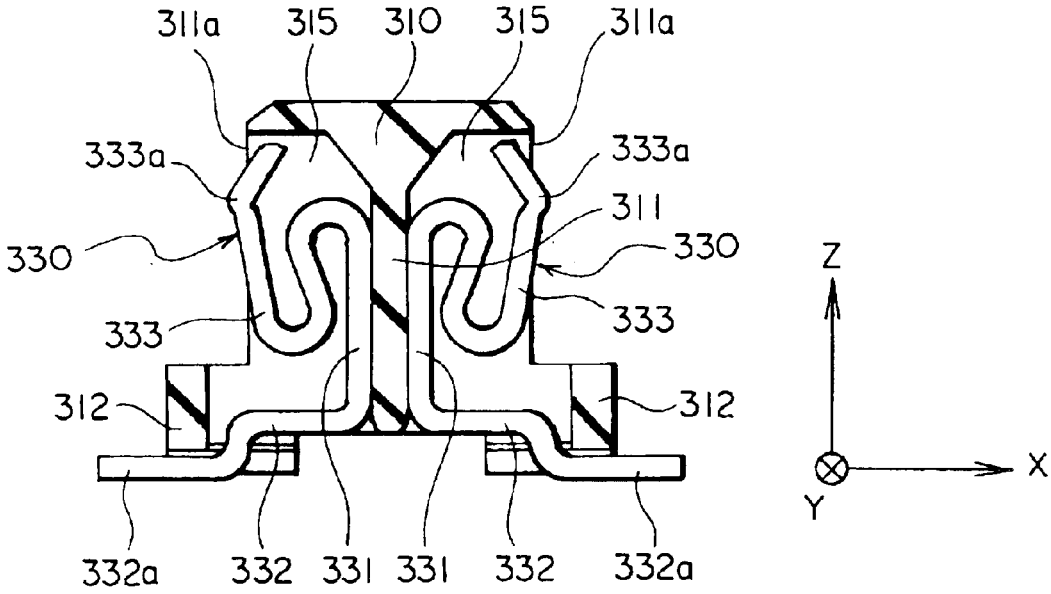
FIG. 16 is a cross-sectional view showing the connector of FIG. 14, taken along lines XVI—XVI.

As shown in FIG. 16, the first holding portion 315 extends from the lower surface of the bottom portion 312 upwardly in the Z-direction but does not reach the upper surface of the insertion head portion 311. The first holding portion 315 also communicates with a side 311*a* of the insertion head portion 311. In other words, the first holding portion 315 connects the lower surface of the bottom portion 312 and the side 311*a* of the insertion head portion 311. Therefore, the contacts 330 can be inserted into the first holding portions 315 from the lower surface of the bottom portion 312.

Figure 17:
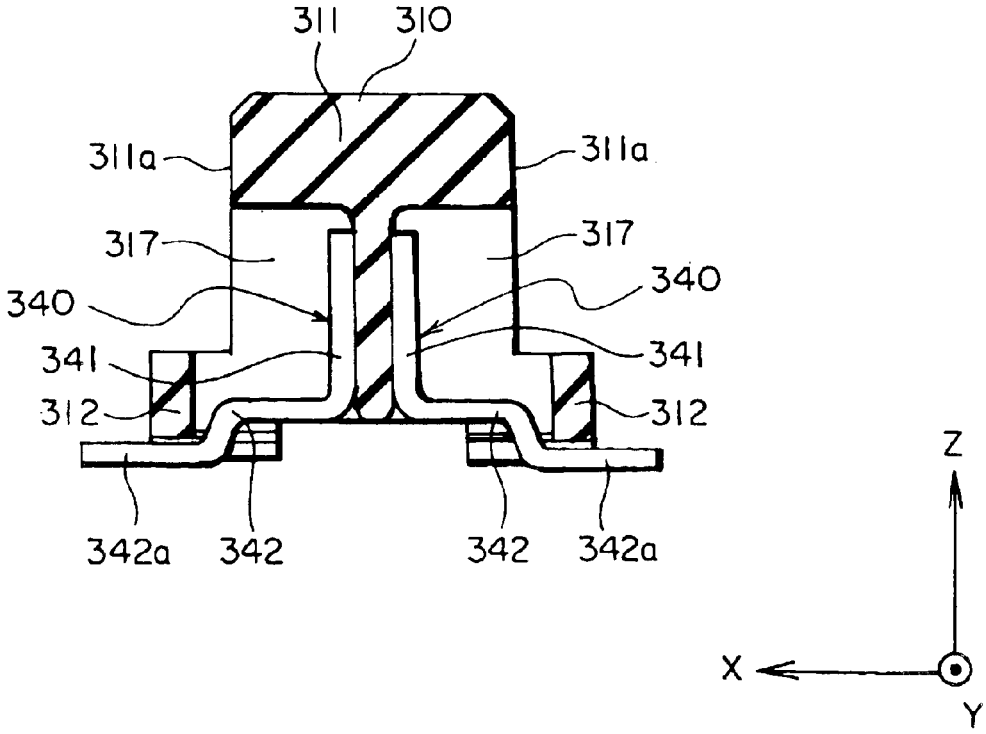
FIG. 17 is a cross-sectional view showing the connector of FIG. 14, taken along lines XVII—XVII.

As shown in FIG. 17, the second holding portion 317 extends from the lower surface of the bottom portion 312 upwardly in the Z-direction but does not reach the upper surface of the insertion head portion 311. The second holding portion 317 is shorter than the first holding portion 315 in the Z-direction. The second holding portion 317 connects the lower surface of the bottom portion 312 and the side 311*a* of the insertion head portion 311, similar to the first holding portion 315. Therefore, the fixity members 340 can be inserted into the second holding portions 317 from the lower surface of the bottom portion 312.

As shown in FIGS. 13 and 14, the first and the second holding portions 315, 317 are grouped into two groups. In one of the groups, the first holding portions 315 are positioned between the second holding portions 317. Specifically, two second holding portions 317, the predetermined number of the first holding portions 315, and other two second holding portions 317 are arranged in this order in the Y-direction. The first and the second holding portions 315, 317 are spaced at regular intervals and are parallel to each other. The other group has the same configuration as the aforementioned group but is arranged symmetrically with the aforementioned group in the X-direction.

Figure 18:
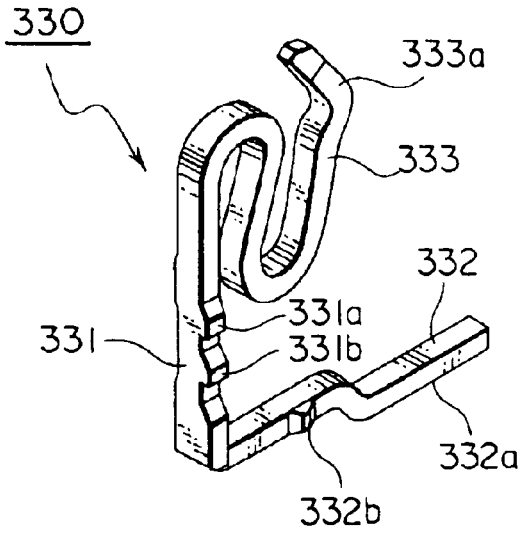
FIG. 18 is a perspective view showing a contact which is included in the connector of FIG. 13.

As shown in FIGS. 16 and 18, each of the contacts 330 is comprised of a held portion 331, a fixing portion 332 and a contact portion 333. The held portion 331 is formed with barbs 331*a,* 331*b,* which are engaged in the inner surface of the first holding portion 315 when the contact 330 is inserted into and press-fitted into the first holding portion 315 from the bottom portion 312. The fixing portion 332 extends from one end of the held portion 331 in a direction perpendicular to the extending direction of the held portion 331. The fixing portion 332 has a cranked shape which consists of three portions. One end portion extending from the held portion 331 is provided with a protrusion 332*b,* which serves to prevent the contact 330 from undesirably moving in the Y-direction when the contact 330 is press-fitted into the first holding portion 315. The middle portion extends in parallel with the held portion 331, and the other end portion is a free end and extends from the middle portion in parallel with the aforementioned end portion. The free end portion of the fixing portion 332 serves as a soldered portion 332*a.* The soldered portion 332*a* is soldered to the substrate when the connector 300 is mounted on the substrate. The contact portion 333 continues from the other end of the held portion 331 and has an S-like shape. The free end of the contact portion 333 is provided with a projection 333*a,* which is a portion brought into contact with a contact of the mating connector when the connector 300 is mated with the mating connector.

As shown in FIG. 16, the contact 330 is inserted into the first holding portion 315 from the bottom portion 212 so that it is held by the first holding portion 315. Under the state where the contact 330 is held by the insulator 310, the projection 333*a* projects from a side 311*a* of the insertion head portion 311 in the X-direction. Therefore, the contact of the mating connector can be brought into contact with the contact 330 when the mating connector is mated with the connector 300 in the Z-direction. The fixing portion 332 projects from the bottom portion 312 outwardly of the insulator 10.

Figure 19:
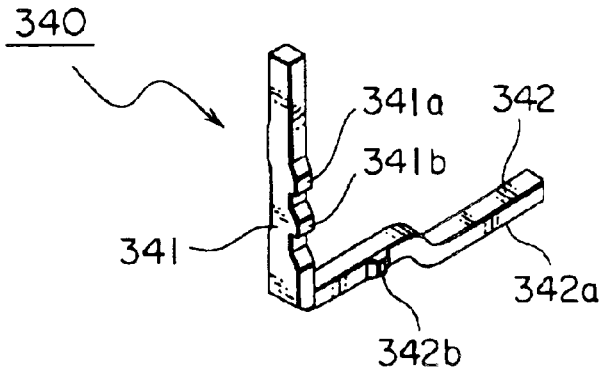
FIG. 19 is a perspective view showing a fixity member which is included in the connector of FIG. 13.

As shown in FIGS. 17 and 19, each of the fixity members 340 is comprised of a held portion 341 and a fixing portion 342. The held portion 341 has the same shape as the held portion 331 and is formed with barbs 341*a,* 341*b.* Like the barbs 331*a,* 331*b* of the contact 330, the barbs 341*a,* 34*ab* are engaged in the inner surface of the second holding portion 317 when the fixity member 340 is inserted into and press-fitted into the second holding portion 317 from the bottom portion 312. The fixing portion 342 has the same shape as the held portion 332 and extends from one end of the held portion 341 in a direction perpendicular to the extending direction of the held portion 341. The fixing portion 342 is provided with a protrusion 342*b,* which plays a role similar to the protrusion 332*b* of the contact 330. The free end of the fixing portion 342 serves as a soldered portion 342*a.* The soldered portion 342*a* is soldered to the substrate when the connector 300 is mounted on the substrate. Thus, the fixity member 340 has a shape similar to the contact 330 except that the fixity member 340 has no contact portion like the contact portion 333 of the contact 330.

Figure 20:
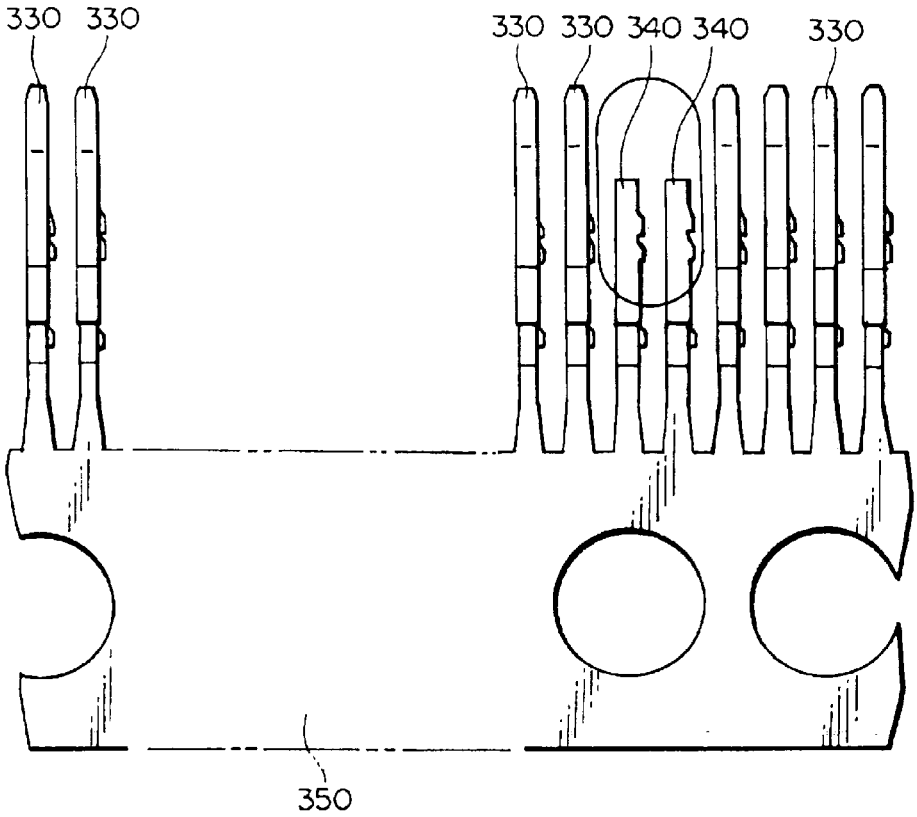
FIG. 20 is a top plan view showing a carrier, with which the contacts of FIG. 18 and the fixity members of FIG. 19 are formed.
Figure 22:
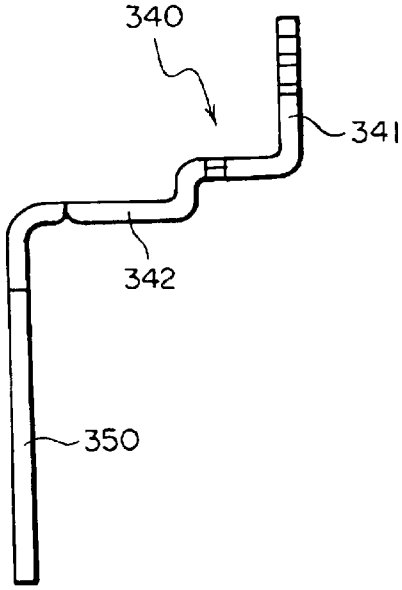
FIG. 22 is a side view showing the fixity member with the carrier of FIG. 20.
Figure 21:
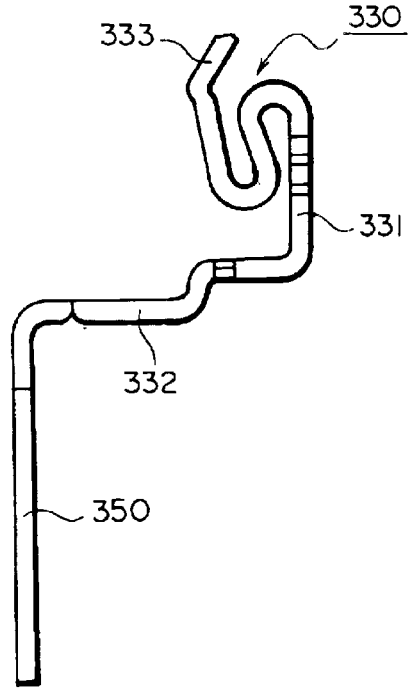
FIG. 21 is a side view showing the contact with the carrier of FIG. 20.

The fixity member 340 can be easily manufactured by cutting off the contact portion 333 from the contact 330, as shown in FIGS. 20 to 22. In practice, the contacts 330 are manufactured by bending a metal preform, which is formed with the barbs 331, 331*b,* 341*a,* 341*b* and the protrusions 332*b,* 342*b.* The fixing members 340 are formed by selecting some contacts 330, followed by cutting away their contact portions while a carrier 350 is still connected thereto, as shown in FIG. 20. As also understood from FIG. 20, the fixing members 340 are made of the same material as the contacts 330, i.e. metal in this embodiment.

As shown in FIG. 17, the fixity member 340 is inserted into the insulator 310 from the bottom portion 312 so that it is held by the insulator 310. In detail, when the held portion 341 is inserted into the second holding portion 317, the barbs 341*a,* 341*b* are engaged in the inner surface of the second holding portion 317 so that the press-fitting is established between the held portion 341 and the second holding portion 317. The fixing portion 342 projects from the bottom portion 312 outwardly of the insulator 310.

Because the first and the second holding portions 315, 317 are spaced at regular intervals and the contacts 330 and the fixity members 340 have the same shape as each other except for the contact portions 333 of the contacts 330, it is easy to fit the contacts 330 and the fixity members 340 into the first and the second holding portions 315, 317, respectively, by means of an automatic fitting machine or the like.

In this embodiment, two fixity members 340 are positioned near to each corner of the connector 300, as seen from FIGS. 13 and 14. In other words, every fixity member 340 is positioned nearer to the corresponding corner of the connector 300 than the contacts 330. Therefore, the fixation of the connector 300 by means of the fixity members 340 is resistant to a rotation force which might be applied to the connector 300. The number of the fixity members 340 arranged near to each corner of the connector is not limited to two but may be one or three or more.

What is claimed is:

1. A connector which is mountable in/on a surface of a substrate and is connectable to a mating connector in a first direction perpendicular to the surface of the substrate, wherein the connector comprises an insulator, a plurality of contacts and a plurality of separate fixity members adjacent to the contacts; the insulator is formed with a plurality of first holding portions for holding the respective contacts and a plurality of second holding portions for holding the respective fixity members; the first and the second holding portions are arranged in a second direction perpendicular to the first direction; each of the contacts has a first held portion held by the corresponding one of the first holding portions, a first fixing portion for fixing the contact on the surface of the substrate, and a contact portion for being brought-into contact with contacts of the mating connector; and the fixity members serve to fix the insulator to the substrate in cooperation with the first fixing portions of the contacts, the connector being characterized in that:

each of the fixity members is made of the same material as the contacts and is comprised of a second held portion and a second fixing portion;

the second held portion has the same shape as the first held portion and is held by the corresponding one of the second holding portions of the insulator; and the second fixing portion has the same shape as the first fixing portion and is for fixing the fixity member on the surface of the substrate, the fixity members do not make electrical contact.

2. The connector according to claim 1, wherein the first and the second fixing portions extend in a third direction perpendicular to the first and the second directions, preferably, wherein the contact portion is provided with a projection which projects in the third direction towards the corresponding one of the first fixing portions.

3. The connector according to claim 1, wherein the first and the second holding portions are spaced at regular intervals in the second direction.

4. The connector according to claim 3, wherein the first and the second fixing portions are arranged parallel to each other.

5. The connector according to claim 3, wherein the first holding portions are positioned between the second holding portions in the second direction.

6. The connector according to claim 1, comprising at least two sets of the contacts and the fixity members, wherein the insulator is formed with two sets of the first and the second holding portions, the sets of the first and the second holding portions are arranged symmetrically in a third direction perpendicular to the first and the second directions, and each set of the first and the second holding portions holds the corresponding set of the contacts and the fixity members.

7. The connector according to claim 1, wherein:

the insulator is comprised of a pair of first wall portions, a pair of second wall portions, a center island portion and a bottom portion;

each of the first wall portions stand up from the bottom portion in the first direction and extends in the second direction;

the first wall portions are spaced from each other in the third direction perpendicular to the first and the second directions;

each of the second wall portions stands up from the bottom portion in the first direction and extends in the third directions;

the second wall portions are spaced from each other in the second direction and connect between the respective ends of the first wall portions;

the center island portion stands up from the bottom portions and is positioned apart from the first wall portions in the third direction and from the second wall portions in the second direction so that an elongated O-like shaped groove is defined between the center island portions and the first and the second wall portions; and the contacts and the fixity members are held by the first wall portions.

8. The connector according to claim 7, wherein each of the first holding portions is formed continuously in the center island portion, the bottom portion and the corresponding one of the first wall potions, and each of the second holding portions is formed continuously in the bottom portion and the corresponding one of the first wall portions.

9. The connector according to claim 8, wherein each of the first and the second holding portions is provided with a fitting hole, which is formed in the corresponding one of the first wall portions and extends in the first direction from the bottom portion, and wherein each of the first and the second held portions is formed with a fitting post, which extends in the first direction and is inserted into and fitted into the corresponding fitting hole from the bottom portion.

10. The connector according to claim 8, wherein the contact portion partially projects from a side of the center island portion in the third direction into the elongated O-like shaped groove.

11. The connector according to claim 1, wherein:

the insulator is comprised of an insertion head portion and a bottom portion;

the insertion head portion stands up from the bottom portion in the first direction and extends in the second direction; and each of the first and the second holding portions is formed continuously in the bottom portion and the insertion head portion and continues to a side of the insertion head portion in the third direction perpendicular to the first and the second directions.

12. The connector according to claim 11, wherein the contact portion partially projects from the side of the insertion head portion in the third direction toward the outside of the insulator.

* * * * *